US010246829B2

(12) United States Patent
Espe

(10) Patent No.: US 10,246,829 B2
(45) Date of Patent: Apr. 2, 2019

(54) COATING OF COMPOSITE WOOD PANELS WITH AMINOPLAST RESIN FILMS FITTED WITH AN ABRASION-RESISTANT, EASY-CLEAN AND HYDROPHOBIC SURFACE

(71) Applicant: HUECK Rheinische GmbH, Viersen (DE)

(72) Inventor: Rolf Espe, Bochum (DE)

(73) Assignee: HUECK Rheinische GmbH, Viersen (DE)

( * ) Notice: Subject to any disclaimer, the term of this patent is extended or adjusted under 35 U.S.C. 154(b) by 0 days.

(21) Appl. No.: 15/737,394

(22) PCT Filed: Jun. 17, 2016

(86) PCT No.: PCT/EP2016/064007

§ 371 (c)(1),
(2) Date: Dec. 18, 2017

(87) PCT Pub. No.: WO2016/207072

PCT Pub. Date: Dec. 29, 2016

(65) Prior Publication Data

US 2018/0187378 A1 Jul. 5, 2018

(30) Foreign Application Priority Data

Jun. 20, 2015 (DE) ..... 20 2015 004 389 U

(51) Int. Cl.

| | |
|---|---|
| ***C23C 18/12*** | (2006.01) |
| ***D21H 27/28*** | (2006.01) |
| ***D21H 19/82*** | (2006.01) |
| ***D21H 19/02*** | (2006.01) |
| ***D21H 19/06*** | (2006.01) |

(52) U.S. Cl.

CPC ..... *D21H 27/28* (2013.01); *C23C 18/127* (2013.01); *C23C 18/1216* (2013.01); *C23C 18/1237* (2013.01); *C23C 18/1254* (2013.01); *C23C 18/1295* (2013.01); *D21H 19/02* (2013.01); *D21H 19/06* (2013.01); *D21H 19/82* (2013.01)

(58) Field of Classification Search

CPC ..... D21H 27/28
USPC ..... 427/355
See application file for complete search history.

(56) References Cited

U.S. PATENT DOCUMENTS 8,449,977 B1 5/2013 Didavide et al.

FOREIGN PATENT DOCUMENTS

| | | | | |
|---|---|---|---|---|
| CN | 101234786 | * | 8/2008 | |
| DE | 195 29 987 A1 | | 2/1997 | |
| DE | 10 2007 019 179 A1 | | 10/2008 | |
| DE | 102007019179 | * | 10/2008 | ..... C03C 17/009 |
| EP | 0 732 449 A1 | | 9/1996 | |
| EP | 1 634 995 A1 | | 3/2006 | |
| EP | 1634995 | * | 3/2006 | ..... B44C 5/0476 |
| WO | 00/44576 A1 | | 8/2000 | |
| WO | WO200044576 | * | 8/2000 | ..... B44C 5/043 |

OTHER PUBLICATIONS

International Search Report of PCT/EP2016/064007, dated Nov. 7, 2016.

* cited by examiner

*Primary Examiner* — Tabatha L Penny
(74) *Attorney, Agent, or Firm* — Collard & Roe, P.C.

(57) ABSTRACT

Finishing of decorative and/or overlay papers impregnated with aminoplast resin which are used for coating composite wood panels and form an abrasion-resistant, easy clean and hydrophobic surface, wherein after resin impregnation, the impregnated papers are coated in a second application step with a sol-gel preparation containing dissolved metal alkoxides and fullerene-like nanostructures and nanotubes made of metal disulfides of the metals molybdenum and/or tungsten and, after drying and final condensation, the surfaces are formed in a hydraulic heating press.

8 Claims, No Drawings

COATING OF COMPOSITE WOOD PANELS WITH AMINOPLAST RESIN FILMS FITTED WITH AN ABRASION-RESISTANT, EASY-CLEAN AND HYDROPHOBIC SURFACE

CROSS REFERENCE TO RELATED APPLICATIONS

This application is the National Stage of PCT/EP2016/064007 filed on Jun. 17, 2016, which claims priority under 35 U.S.C. § 119 of German Application No. 20 2015 004 389.5 filed on Jun. 20, 2015, the disclosure of which is incorporated by reference. The international application under PCT article 21(2) was not published in English.

The invention relates to the finishing of aminoplast resin films with an abrasion-resistant, easy clean and hydrophobic surface for coating composite wood panels, which are used to produce floor panels or in applications in the furniture industry.

By aminoplast resin films is meant melamine, formaldehyde condensation resins or mixed resins of urea and melamine, which undergo a final condensation and are crosslinked under specific pressure and temperature conditions.

Melamine resin films are used for coating HDF boards (High Density Fiber-boards) which are then processed to produce floor panels. Printed decorative papers made from alpha cellulose impregnated with melamine resin which is then pre-condensed in the drying zone of an impregnating channel is used for this purpose. As a rule, the decorative papers are pressed together with impregnated overlay papers of 20 to 45 g/m2 in a hydraulic heating press. The overlay is used to harden decorative films and other heavy duty surfaces. It comprises high-quality alpha cellulose papers which are impregnated with melamine resin and additionally contain defined quantities of mineral filler, such as corundum, for example.

Floor panels need to be relatively resistant to abrasion and their surfaces are therefore reinforced with these fillers. A hard material which has proved to be suitable in this respect due to its hardness, transparency and inertness is $Al_2O_3$ in the form of fused corundum, sintered corundum, monocrystalline corundum and/or calcined or sintered alumina.

Based on the prior art, such hard materials can be applied in different ways. For example, these hard materials can be directly mixed with the melamine impregnating resin for the paper surface coating. In another case, a specific quantity of corundum is added to the base paper compound for the overlay paper directly during the paper production process, thereby obviating the need to add corundum during the resin impregnating process.

EP 0732449 A1 discloses a method for producing decorative paper for use in the production of abrasion-resistant laminates. In this instance, abrasion-resistant minerals such as corundum are added to the resin.

DE 195 29 987 A1 describes a method for producing highly abrasion-resistant lacquer coatings on a solid substrate. This lacquer coating is produced from synthetic lacquers such as acrylic resin, polyester resin or polyurethane resin lacquer, and a wear-reducing agent is applied to the lacquer coatings prior to curing. Another publication, EP 1070688 A1, describes a surface-coated hard material of a specific hardness. This hard material is added to the lacquer coatings as a wear-reducing agent.

Synthetic corundum is usually produced in an electric arc furnace by melting the starting material, alumina or bauxite, at ca. 2000° C. The product obtained from this process is in the form of blocks, which are ground after cooling and then processed to a specific grain size.

After being ground, corundum has a very jagged surface with many edge dislocations, micro-edges and cracks due to its brittle fracture behavior.

During the subsequent pressing operation in the heating press, these corundum particles cause considerable problems on the surfaces of the press plates used.

The melamine resin films together with the overlay films are pressed under pressure and temperature in so-called hydraulic heating presses having appropriate press plates which may be structured, matt or glossy. The melamine resin films undergo a final condensation during this process and form irreversible hard surfaces. After pressing, the corundum particles are located on the surfaces of the coated composite wood panels.

As a rule, the press plates used are made from hard chrome steels conforming to AISI 410, AISI 630 with a hardness of 38–42 HRC. However, brass plates MS 64 with a hardness of 130 HB may also be used. In order to improve the separation characteristics of the metal surfaces with respect to the melamine resins and protect the surfaces from scratches, the plate surfaces are provided with a chrome plating, which is applied electrochemically in a bath of chromic acid with Cr(VI) compounds. The layers of chrome plating are intended to have functional properties and the aim is therefore to obtain hard chrome layers of more than 20 μm.

Although the chromed plate surfaces a have hardness of 1000 to max, 1200 HV, the plate surface is nevertheless subject to premature wear, which alters the gloss of the chrome layer. This occurs due to the vast differences in hardness, corundum having a Vickers hardness of 1800 to 2000 HV. Movements occur during the pressing operation, caused by plate expansion once the hot plates have been applied. The press plates undergo a jump in temperature because they come into close contact with the hot plate. On the other hand, the progressive condensation of the melamine resins causes the surface to shrink, thereby creating strong friction under the high pressure which causes premature wear of the plate surfaces. The plate surfaces therefore have to be treated again and re-chromed relatively quickly.

The underlying objective of the invention is to finish decorative papers and overlays impregnated with aminoplast resin in such a way that premature wear of the chromed press plate surfaces is prevented, the aminoplast resin surfaces are resistant to abrasion after final condensation and an easy clean and hydrophobic surface is created in addition.

This objective is achieved as proposed by the invention due to the fact that after being impregnated with an aminoplast resin, the decorative and/or overlay papers are provided with an additional sol-gel coating incorporating nanostructured tungsten disulfide or molybdenum disulfide and the nanostructures of the metal disulfides are provided in the form of fullerene-like nanoparticles and nanotubes.

Additionally incorporating the fullerene-like nanoparticles of, for example, tungsten disulfide in the sol-gel mixture results in surfaces with an extra high separation and sliding effect once the films have hardened. This prevents wear on the press plate surfaces and improves the tribological properties of the composite layers. The surface layers of $Al_2O_3$, $TiO_2$ or $SiO_2$, for example, obtained by the sol-gel process create the hardness of the surfaces of the subsequently coated composite wood panels and additionally create an easy clean and hydrophobic surface.

The sol-gel process is a wet-chemical process for producing ceramic as well as hybrid organic-inorganic materials. Thin layers but also small particles and fibers, aerogels and xerogels and also monolithic materials can be produced using the sol-gel process. In principle, the sol-gel process involves two typical stages through which each product passes. First of all a sol is produced, which consists of finely dispersed colloidal particles of approximately 1 nm to 100 nm in size in a liquid or of dispersed oligomers consisting of branched macromolecules. To create the sol, a so-called precursor is used, namely metal alkoxides or metal salts which are dissolved in water or in some other liquid. When, for example, the hydrolyzable alcoholates of multivalent metal ions (M=Ti, Si, or Al) from an alcohol solution are applied to a surface, a metal hydroxide network forms in the presence of $H_2O$ as soon as the solvent evaporates, even at low temperatures. This then contains numerous MOH groups and is therefore hydrophilic and antistatic.

The hydrolysis and condensation reactions result in a growth of particles and increased polymerization until a solid network is finally formed within the liquid phase, which is then referred to as a gel. Due to evaporation of the solvent, a xerogel is formed from the gel which then turns into a solid and compact form when exposed to higher temperatures. Splitting of the $H_2O$ causes metal oxide groups to form and the surfaces become hard and scratch-resistant.

Thin layers can be deposited on or applied to the impregnated decorative or overlay papers, also referred to as substrate in the description below, by means of various coating processes. For example, dip-coating and spin-coating may be used, whilst coating by means of a blade or application using a distributor roller have also proved suitable for applying a one-sided surface coating. The substrate is usually coated with the liquid sol. After application, the solvent then evaporates so that the concentration of particles becomes significantly higher, which then causes the particles to bond with one another to create a gel and hence a solid but still porous layer. This layer, also known as a xerogel, still contains small amounts of the solvent. It is not until the heating process in the adjoining drying zone of the impregnating channel that the solid phase of the metal oxide starts to form from the sol-gel process, after which the total hard layer of metal oxides forms on final condensation of the impregnating resins in the heating press when subjected to pressure and temperature.

The choice of metal oxides is made depending on the desired surface hardness. Metals which have proved to be suitable metal compounds are aluminum, zirconium, titanium and silicon. Very good sol-gel layers can be produced by means of their oxide compounds. Two sol-gel layers will be described below, namely $Al_2O_3$ and $SiO_2$.

The starting material for preparing $Al_2O_3$ may be a Yoldas sol, for example. The first step of the method is the hydrolysis of aluminum alkoxide, whereby, for example, aluminum-tri-sec-butoxide $Al(OCH(CH_3)C_2H_5)_3$ is hydrolyzed in a large surplus of water at ca. 85° C. This results in an aluminum hydroxide suspension to which a small quantity of nitric acid $HNO_3$ is then added to obtain a clear sol and/or a colloidal solution.

If it is desirable to operate the Yoldas process with a lower stoichiometric water content, aluminum-tri-sec-butoxide is mixed with absolute ethanol and acetic acid in a ratio of Al-tri-sec-butoxide:$C_2H_5OH$:$H_2O$ (DI)=1:16:0.6 and heated to ca. 65° C. whilst continually stirring for ca. 50 minutes, for example. The originally cloudy mixture becomes slowly clear after the onset of hydrolysis. The clear sol mixture is cooled to room temperature. In the second step, a gel is produced by adding methanol $CH_3$ and $H_2O$, the weight ratios of which may be approximately sol:$CH_3$:$H_2O$=1 g:0.2 g:0.003 g, to which a small quantity of acetic acid is then added.

Another sol might be prepared from a commercially available boehmite powder.

To prepare $SiO_2$ gels, silicic acid esters may be used, for example a tetraethyl orthosilicate TEOS is used as a precursor. Such hybrid organic-inorganic layers of organically modified silicates are often referred to as ormosils. Various materials may be used to prepare ormosil layers, in particular starting with different silanes. The subsequent mechanical behavior of the sol-gel layers will depend on the chemical structure and their concentration in the sol. For example, a silane of formula $(OC_2H_5)_3Si—(CH_2)_3—CH(O)CH_2$ 3-glycidoxypropyltrimethoxysilane may be used, also known under the brand names Dynasyl-An® or GLYMO. If the intention is to increase the hardness of the layers, nanoparticles of $SiO_2$ or $Al_2O_3$ may also be added in addition. OH groups on the surface of the colloidal, amorphous $SiO_2$ particles can then react with the silane used and thus incorporate the particles in the layer matrix. Another option would be to prepare layers of organically modified $SiO_2$ with a hydrophilic or hydrophobic or dirt-repellent effect.

After producing the sol, which is provided for the coating, followed by the preparation for the inorganic fullerene-like tungsten disulfide particles, the two preparations are brought together.

Inorganic fullerene-like nanoparticles and nanotubes have particle diameters of 10 to 25 nm. Nanotubes have diameters of 10 to 25 nm and lengths of 200 to 300 nm. The first inorganic fullerene-like particles of tungsten disulfide or molybdenum disulfide were observed in thin layers produced by sulfidizing $WO_3$ layers and/or $MoO_3$ layers in a reducing atmosphere. Inorganic fullerenes were produced for the first time in Israel in 1990 and the materials used were tungsten disulfide ($WS_2$) and molybdenum disulfide ($MoS_2$). Since then, numerous other inorganic fullerene-like materials have been produced, such as $TiS_2$, selenides, bromides and chlorides such as $NiBr_2$, $NiCl_2$, as well as various oxides such as $V_2O_5$ and boron nitride. For the application on which the invention is based, tungsten disulfide and molybdenum disulfide were chosen. Tungsten disulfides in the form of fullerene-like nanoparticles and nanotubes are extremely suitable for a number of uses and applications due to their physical properties and crystallographic morphology. Fullerene-like tungsten disulfide has proved to be outstandingly effective in the sol-gel preparation process and prevents subsequent wear on the coated composite wood panels during subsequent use. Wear on the press plates during the pressing operation is likewise prevented. The lubricating effect of tungsten disulfide and molybdenum disulfide in tribological contact is primarily based on the formation of a thin film of $WS_2$ and/or $MoS_2$, which forms in the contact zone on the surfaces of rubbing bodies. This so-called tribofilm enables surfaces to slide on one another with little friction and this reduces wear of the rubbing bodies. This effect is therefore totally positive with respect to frictional forces acting on the chromed press plate surfaces.

Most inorganic fullerene-like tungsten disulfide particles are commercially available in the form of dry powder. Due to the production process, however, the particles are quite tightly packed (aggregated) and agglomerated and thus form secondary particles with a diameter of a few micrometers. If the powder is added directly to water and ethanol or to an aqueous sol in this form, the tungsten disulfide precipitates due to the high mass. The tungsten disulfide particles must therefore be de-agglomerated before being used to produce the preparation in the sol-gel process and stabilized in the sol as individual particles. The use of dispersing agents has proved to be of advantage. For example, the $WS_2$ powder is dispersed with cetyltrimethylammonium bromide sold by Sigma-Aldrich or with Pretoctol (BASF) by means of ultrasound technology.

The proportion of fullerene-like tungsten disulfide $WS_2$ in the sol will depend on the desired surface finish of the coated composite wood panels and the mold releasing properties of the press plates used and may be 1 to 50%, relative to the proportion of solids.

Having been prepared in this manner, the sol-gel preparations incorporating the dispersed $WS_2$ particles are then applied to the surfaces of the resin-impregnated decorative or overlay papers, as described above.

The sol-gel coating may be applied in impregnating-drying systems of the type known from the prior art used for impregnation with thermosetting resins. This being the case, the overlay paper is firstly impregnated with the appropriate liquid aqueous aminoplast resin and dried in the heated drying zone to the point where it has a specific moisture content, for example, undergoing a pre-condensation at the same time. In a second application zone, the prepared sol incorporating the fullerene-like $WS_2$ particles is applied before the transfer to the heated drying channel. The speed and channel temperature will depend on the respective resin parameters, which will be set by the user beforehand.

The invention claimed is:

1. A method comprising:

providing decorative and/or overlay papers, impregnating the decorative and/or overlay papers with aminoplast resin to form impregnated papers, after the impregnation, coating the impregnated papers with a sol-gel preparation comprising:

dissolved metal alkoxides, fullerene-like nanostructures made of metal disulfides of molybdenum and/or tungsten, and fullerene-like nanotubes made of metal disulfides of molybdenum and/or tungsten such that coated papers are formed, drying the coated papers to form dried papers, and pressing the dried papers in a hydraulic heating press such that the dried papers are condensed and such that an abrasion-resistant, hydrophobic surface is formed on the dried papers so that finished papers are formed.

2. The method according to claim 1, wherein the metal alkoxides are selected from the group consisting of aluminum, titanium, silicon, and zirconium.

3. The method according to claim 1, further comprising: dispersing nanoscale metal oxides in the sol-gel preparation.

4. The method according to claim 3, wherein the nanoscale metal oxides are selected from the group consisting of $SiO_2$, $Al_2O_3$, $TiO_2$, and $ZrO_2$.

5. The method according to claim 1, further comprising: dispersing the fullerene-like nanostructures and nanotubes with cetyltrimethylammonium bromide or with benzyl-C12-14-alkyldimethylammonium chloride.

6. The method according to claim 1, further comprising: preparing the sol-gel preparation by using 3-glycidoxypropyltrimethoxysilane, wherein the sol-gel preparation comprises an ormosil.

7. The method according to claim 1, further comprising: preparing the sol-gel preparation by using $Al(OCH(CH_3)C_2H_5)_3$, wherein the sol-gel preparation comprises a Yoldas sol.

8. The method according to claim 1, further comprising providing a composite wood panel such that the finished papers are a coating on the composite wood panel.

* * * * *